US005459971A

United States Patent [19]

Sparkman

[11] Patent Number: 5,459,971

[45] Date of Patent: Oct. 24, 1995

[54] CONNECTING MEMBER FOR CONCRETE FORM

[76] Inventor: Alan Sparkman, 277 Ready Mix Rd., London, Ky. 40741

[21] Appl. No.: 206,541

[22] Filed: Mar. 4, 1994

[51] Int. Cl.[6] ..... E04B 2/38

[52] U.S. Cl. ..... 52/426; 52/105; 52/309; 52/11; 52/427; 52/562; 52/564; 52/565; 52/568; 52/592.6; 52/712

[58] Field of Search ..... 52/422, 426, 309.11, 52/309.12, 562, 564, 565, 568, 427, 436, 592.6, 712, 105, 426

[56] References Cited

U.S. PATENT DOCUMENTS

| | | | |
|---|---|---|---|
| 836,589 | 11/1906 | Layfield et al. . | |
| 1,871,318 | 8/1932 | Greenwood . | |
| 3,730,475 | 5/1973 | Werfel et al. . | |
| 3,778,020 | 12/1973 | Burrows et al. . | |
| 3,788,020 | 1/1974 | Gregori . | |
| 3,872,636 | 3/1975 | Nicosia . | |
| 3,922,828 | 12/1975 | Patton . | |
| 3,979,867 | 9/1976 | Sowinski . | |
| 4,223,501 | 9/1980 | DeLozier . | |
| 4,229,920 | 10/1980 | Lount . | |
| 4,655,014 | 4/1987 | Krecke | 52/105 |
| 4,702,048 | 10/1987 | Millman . | |
| 4,742,659 | 5/1988 | Meilleur . | |
| 4,860,515 | 9/1989 | Browning, Jr. . | |
| 4,879,855 | 11/1989 | Berrenberg . | |
| 4,884,382 | 12/1989 | Horobin . | |
| 4,889,310 | 12/1989 | Boeshart . | |
| 5,065,561 | 11/1991 | Mason . | |
| 5,123,222 | 6/1992 | Guarriello et al. . | |
| 5,216,863 | 6/1993 | Nessa et al. . | |
| 5,390,457 | 2/1995 | Mensen | 52/426 |

*Primary Examiner*—Carl D. Friedman
*Assistant Examiner*—Christopher Todd Kent
*Attorney, Agent, or Firm*—Camoriano & Smith

[57] ABSTRACT

A connector member for a concrete form includes connecting mechanisms adjacent its top and bottom edges for holding two connecting members together.

25 Claims, 9 Drawing Sheets

CONNECTING MEMBER FOR CONCRETE FORM

BACKGROUND OF THE INVENTION

The present invention relates to forms which are used for receiving concrete, and, in particular, to a connecting member which is used in such a form.

The general type of form which is used in the present invention has been known and used for some time. It includes two lightweight panels (preferably made of polymeric foam) which are connected together by connecting members to form a block which can be stacked with other, identical blocks, to make a hollow wall that can be filled with concrete. The panels are aligned so that continuous vertical and horizontal concrete beams are formed when the concrete is poured into the forms. Once the concrete has been poured, the lightweight panels and the connectors remain in the wall. The lightweight panels then provide insulation, and the connectors provide a structure to which gypsum board or other finishes can be attached.

In the past, there have been several difficulties with these blocks. One problem is that the blocks sometimes separate or "float" when they are being filled with concrete, which can put them out of proper alignment and allow concrete to leak through the space between blocks. This can create serious problems. To solve this problem, the blocks have been wired together or glued together, but sometimes there still is a problem with float. Once the wall is full of concrete, it is impossible to shift the blocks back into proper position. The problem then is remedied as much as possible by trimming the wall after the concrete has set up.

Another problem involves attaching materials to the outside of the wall after it is poured. The connectors usually provide the material to which drywall, bricks, or other finish material are fastened. In the prior art, the connectors have been made of metal. Since metal is a good conductor of heat, the connectors have typically not extended all the way to the exterior of the wall. A bit of foam has been left on the outside of the connectors, so that the foam serves as an insulator. However, when the connectors are completely embedded in foam, the connectors are not visible, and the people who add the wall finishings may have some difficulty finding the connectors to which they have to attach the finish materials.

Since the connectors cannot be seen from the outside of the wall, it is also impossible to tell at a glance whether the blocks have been stacked correctly so as to provide a continuous concrete beam in the finished structure. If there has been an error in stacking the blocks and there is not a continuous concrete beam, the strength of the structure can be compromised.

In many prior art connectors, the attachment portion of the connector does not extend the full height of the block, so there are gaps in the attachment portion where, if someone tries to put in a screw to hold on drywall or other finish materials, there is nothing to receive the screw.

Also, in order to make the metal connectors lightweight enough so that the blocks are not too heavy, and to make them so that they can easily be pierced by screws for attaching finish materials to the walls, the metal connectors are made of very thin sheet metal material. That means that, in general, only a single thread of the screw is in contact with the metal connector. If there are forces on the finish material which cause it to shift up and down or side to side relative to the metal connector, the screw can enlarge the hole in the metal connector and become loose. Also, if the construction is near the ocean or in another environment in which corrosion is likely, it is possible for the metal connector to corrode so that the connection between the finish material and the wall becomes loose.

Another problem with prior art connectors is that they tend to have relatively small holes through which the concrete has to flow when the wall is being poured. These small holes can impede the flow of the concrete, making it difficult to completely fill the wall with concrete. Air pockets in the concrete can compromise the integrity of the finished wall.

Another problem with the prior art blocks is that, when a horizontal reinforcing bar is added to the block before the concrete is poured, there is generally no good way to be sure the reinforcing bar ends up in the right place to provide the proper reinforcement for the finished wall. The reinforcing bar usually just lies on top of a connector, so the bar ends up at the bottom of a horizontal concrete beam. This is usually not the ideal position for the reinforcing bar to provide the most strength to the wall.

SUMMARY OF THE INVENTION

The present invention provides a connector and a block which solve the problems of the prior art.

The connectors of the present invention include cooperating attachment devices on their top and bottom edges so that, when the blocks are stacked, attachment devices on two adjacent layers of the wall connect to each other, thus preventing problems of separation of the blocks or "float".

The present invention provides blocks in which there is an external, visual indicator of the location of the connectors in order to allow the people who attach finishes to the wall to readily know where those finishes should be attached and in order to allow the people who are stacking the blocks to make a quick, visual inspection to be sure the blocks are properly aligned.

In some embodiments, the connectors themselves provide a continuous, visible connector along the entire height of the wall. In others, paint or some other marking is put on the outside of the wall to indicate the location of the connectors. Alternatively, a slight indentation or raised rib may be molded on the outer surface of the block to indicate the location of the connector.

The connectors of the present invention are preferably made of plastic, which is softer and more light-weight than metal, so the attachment members can be made much thicker than prior art attachment members. Since the attachment members are thicker, several threads of the screw are received in the attachment members, making a much more secure attachment of finish materials than in the prior art. This greatly reduces the opportunity for the screw to rock in the hole and enlarge the hole. Also, since the connector is made of a polymer, it will not corrode. The polymeric material also serves as an insulator, so the connector can extend all the way from one outside surface of the structure to the other outside surface without concern about heat losses.

The connectors of the present invention also provide a large, central opening so that concrete can easily flow through the connector.

These and many other benefits of the present invention will be seen in the description which follows.

DESCRIPTION OF THE PREFERRED EMBODIMENTS

Figure 1:
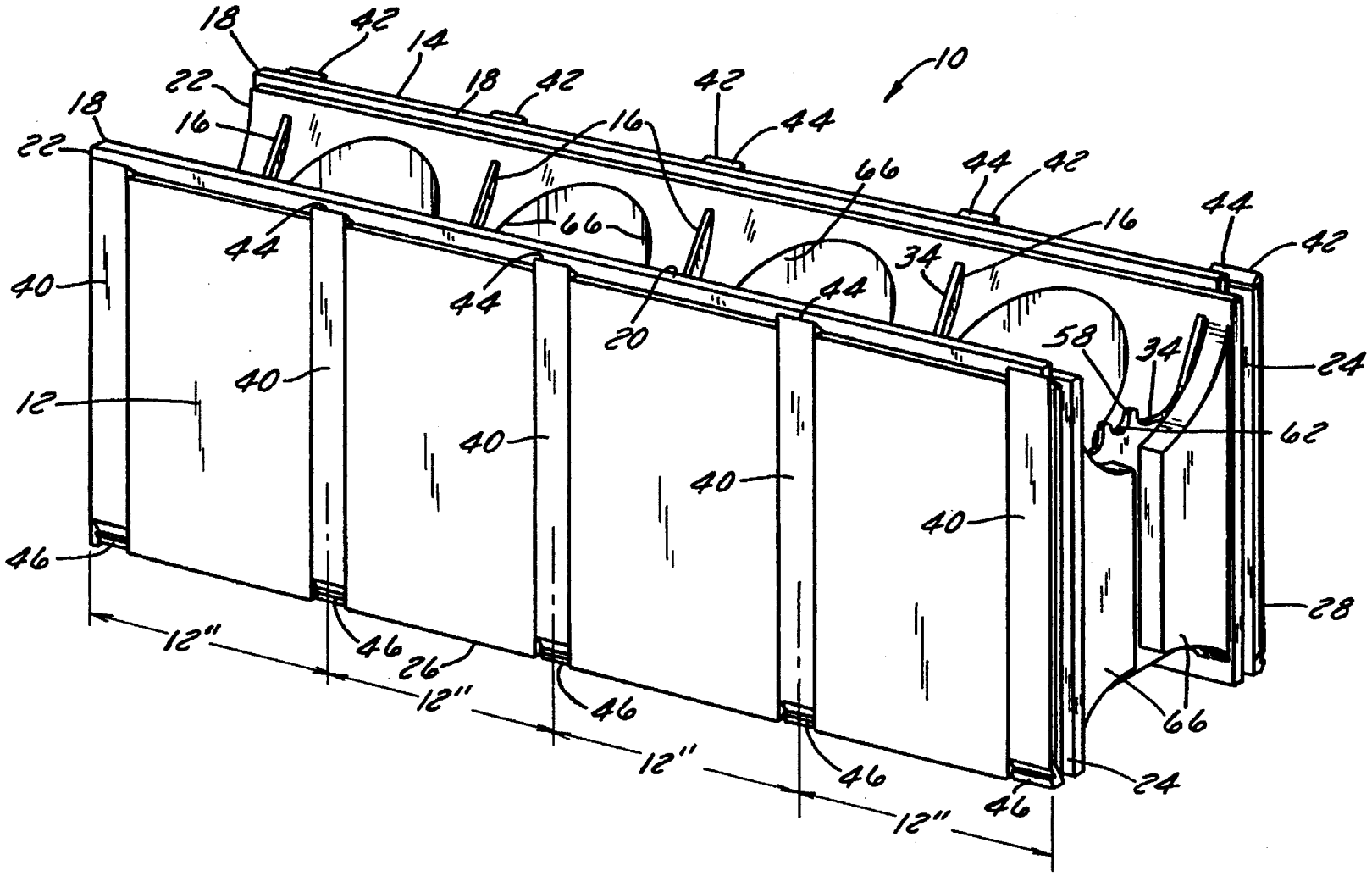
FIG. 1 is a perspective view of a block made in accordance with the preset invention.

One embodiment of the block of the present invention is shown in FIG. 1. This block 10 is made up of two parallel, lightweight sheets 12, 14, which are preferably made of polymeric foam material (i.e. expanded polystyrene). The left sheet 12 and right sheet 14 are connected together by connectors 16.

Figure 2:
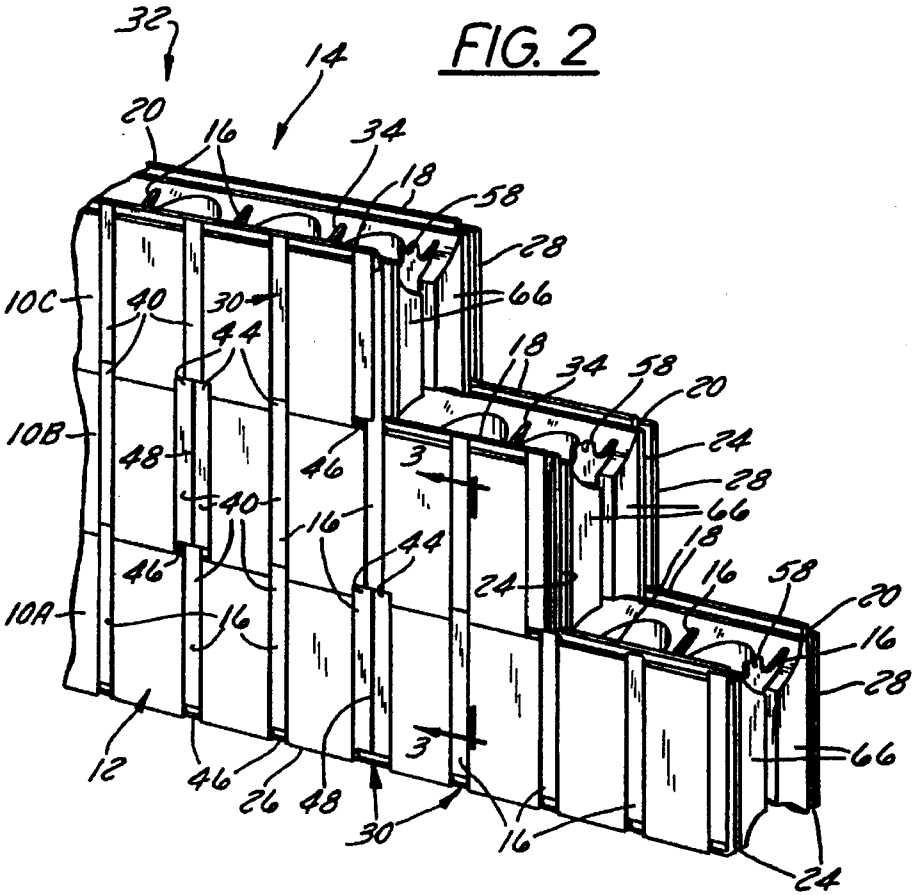
FIG. 2 is a broken-away perspective view of several of the blocks of FIG. 1 stacked up to make a portion of a wall.

The sheets 12, 14 are made with a tongue 18 in their top edge 20 and forward edge 22 and a groove 24 in their bottom edge 26 and rear edge 28 so that the blocks 10 can readily be stacked together with other, identical blocks, as shown in FIG. 2, with the tongues 18 in the top edge 20 of a lower block 10A fitting into the grooves 24 in the bottom edge 26 of an upper block 10B, and the tongues 18 in the forward edge 22 of a block on the rear fitting into the grooves 24 in the rear edge 28 of the next adjacent forward block.

Returning now to FIG. 1, each block 10 has several connectors 16 holding the sheets 12, 14 in parallel alignment with each other. The block 10 shown in FIG. 1 is four feet long and has five connectors 16 in it. The three inner connectors 16 are on twelve-inch centers, as shown, and the forward and rear end connectors 16 are placed so that their forward and rear edges, respectively, are twelve inches from the center of the next adjacent connector 16 in the block 10. This means that, when several of the blocks 10 are stacked together as shown in FIG. 2, the rear-most and forward-most connectors 16 of two adjacent blocks 10A in the same course abut each other, and the connectors 16 of upper and lower blocks 10 are aligned, so as to provide continuous, vertical strips 30 of connectors 16. Since the connectors 16 are visible from the outside of the blocks 10, the continuous, vertical strips 30 are visible from the outside of the wall 32, providing a visual indicator on the outside of the block, showing where the connectors 16 are located. This makes it easy for construction personnel to attach gypsum board or other finish materials to the wall 32 after the concrete has been poured. It also makes it easy for the people stacking the blocks 10 to be sure the blocks are in proper alignment, so there will be continuous concrete beams in the final structure.

Figure 4:
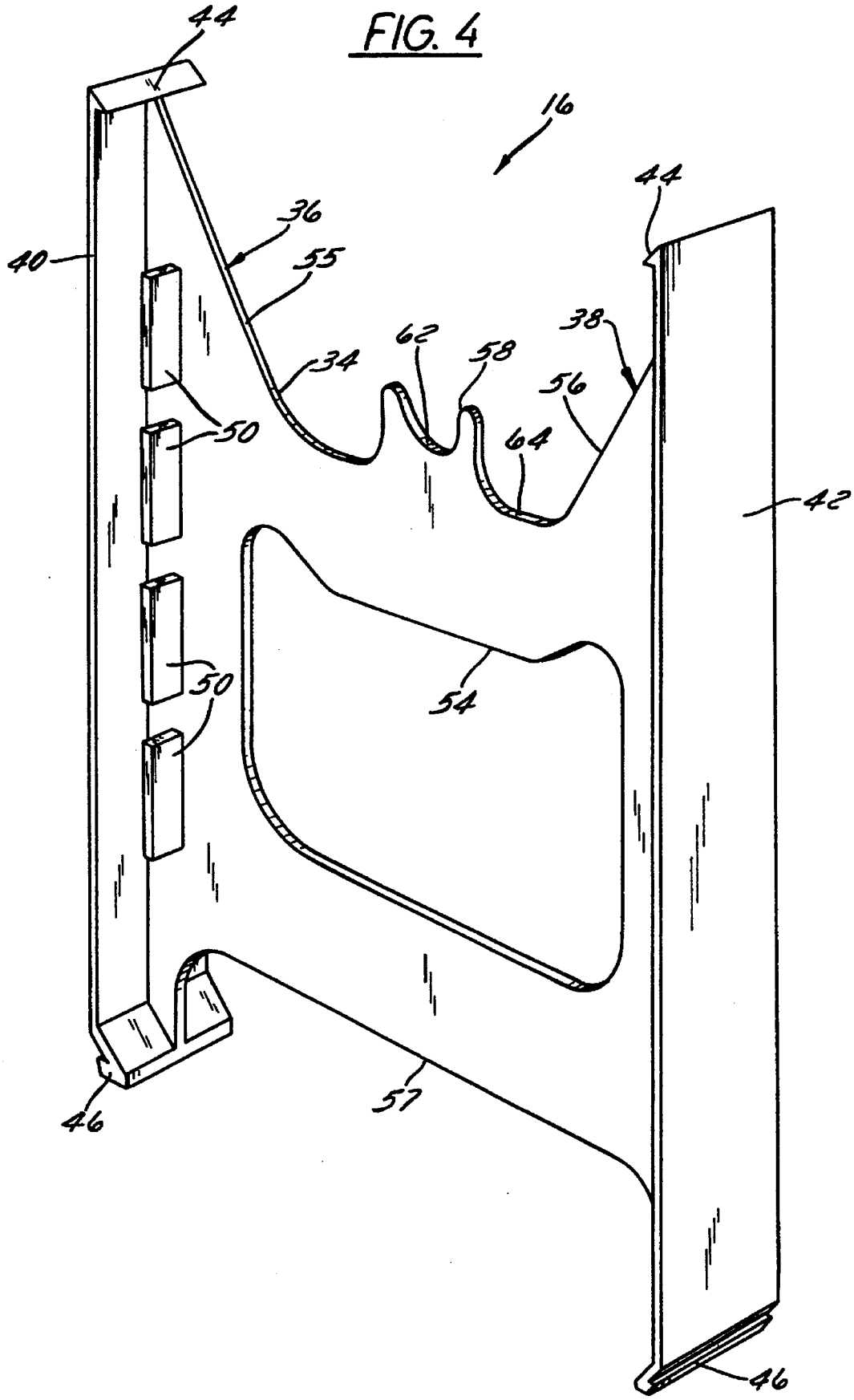
FIG. 4 is a perspective view of one of the connectors of the block shown in FIG. 1.
Figure 7:
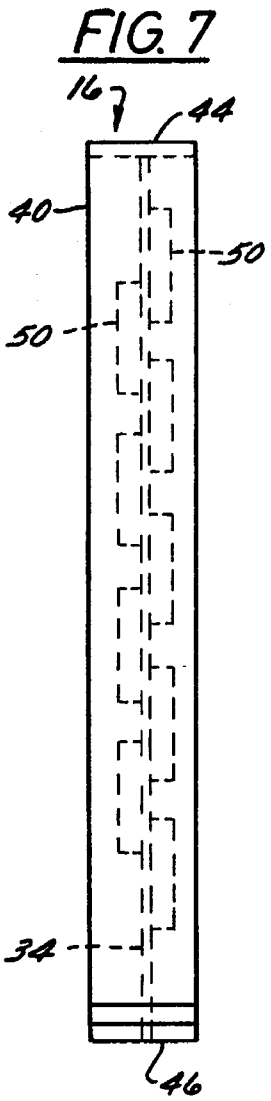
FIG. 7 is a side view of the connector of FIG. 4.
Figure 5:
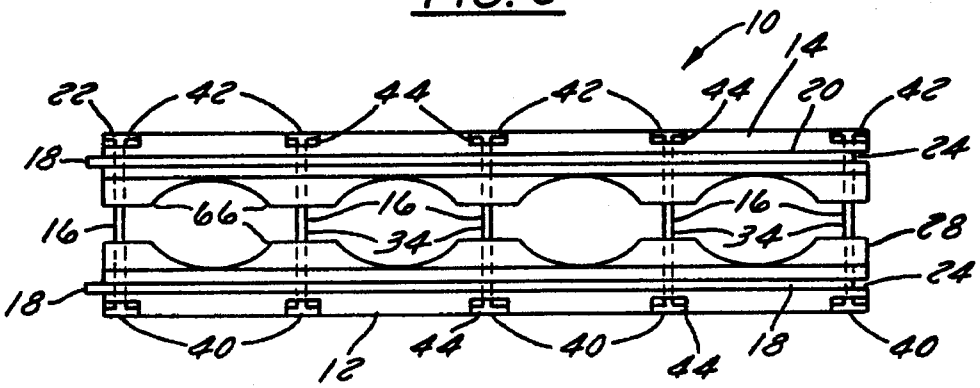
FIG. 5 is a top view of the block of FIG. 1.
Figure 6:
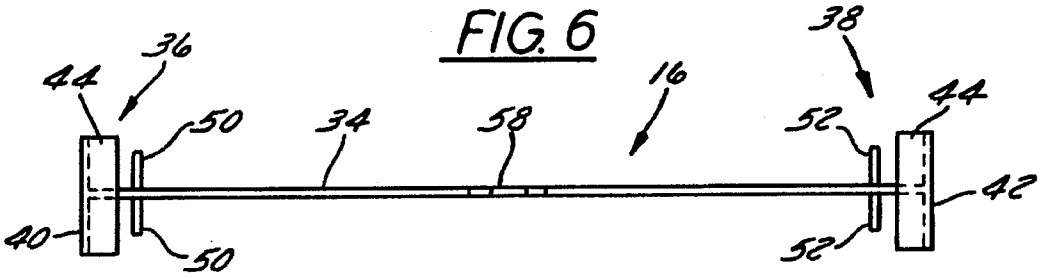
FIG. 6 is a top view of the connector of FIG. 4.

A single connector 16, as used in the block 10 of FIG. 1, is shown in FIGS. 4, 6, and 7. The connecting member 16 includes a connecting web 34, which has a left end 36 and a right end 38. The connecting web 34 terminates in left and right transverse attachment flanges 40, 42, respectively. The attachment flanges 40, 42 extend across the web 34, so that the web 34 lies approximately at the midpoint of the attachment flanges 40, 42. The web 34 and one attachment flange 40 form a T-shaped cross-section, and the web 34 and both attachment flanges 40, 42 form a substantially I-shaped cross-section. Each attachment flange 40, 42 includes an upper fastener mechanism 44 and a lower fastener mechanism 46. The upper hooks 44 are inwardly-directed, and the lower hooks 46 are outwardly-directed and recessed from the plane of the outside surface of their respective flanges 40, 42 so that, when upper and lower hooks 44, 46 are connected together, there is a flat, continuous connector flange strip 30. The hooks 44, 46 in the preferred embodiment extend the full width of the attachment flanges 40, 42.

FIG. 2 shows the blocks 10 stacked in three courses. For clarity, we will refer to the lower course of blocks as 10A, the middle course as 10B, and the upper course as 10C. When the blocks 10 are stacked, as shown in FIG. 2, the upper hook 44 of a lower block 10A hooks into the lower hook 46 of the next adjacent upper block 10B. This holds the blocks 10A and B together and provides a continuous attachment surface along each vertical strip 30 of connectors 16 from the top of the wall 32 to the bottom of the wall 32. Where the forward end 22 of one block 10B abuts the rear end 28 of an adjacent block 10B, the adjacent connectors 16 abut each other, and the line 48 along which they abut is aligned with the centerline of the connectors 16 above and below them, so that half of the upper hook 44 of the forward connector 16 on the rear block 10B and half of the upper hook 44 of the rear connector 16 on the forward block 10B hook into the lower hook 46 of the connector 16 in the block 10C lying above the abutment line 48. Likewise, half of each of the lower hooks 46 of the abutting connectors 16 on the blocks 10B hooks into the upper hook 44 of the next lower connector 16 on the block 10A. Despite the abutment line 48 and other seam lines in the connector strips 30, the connector strips are effectively continuous, because, at any point along the connector strip 30, including the abutment line 48, a connecting screw can be inserted to hold a finish material onto the wall.

Figure 3:
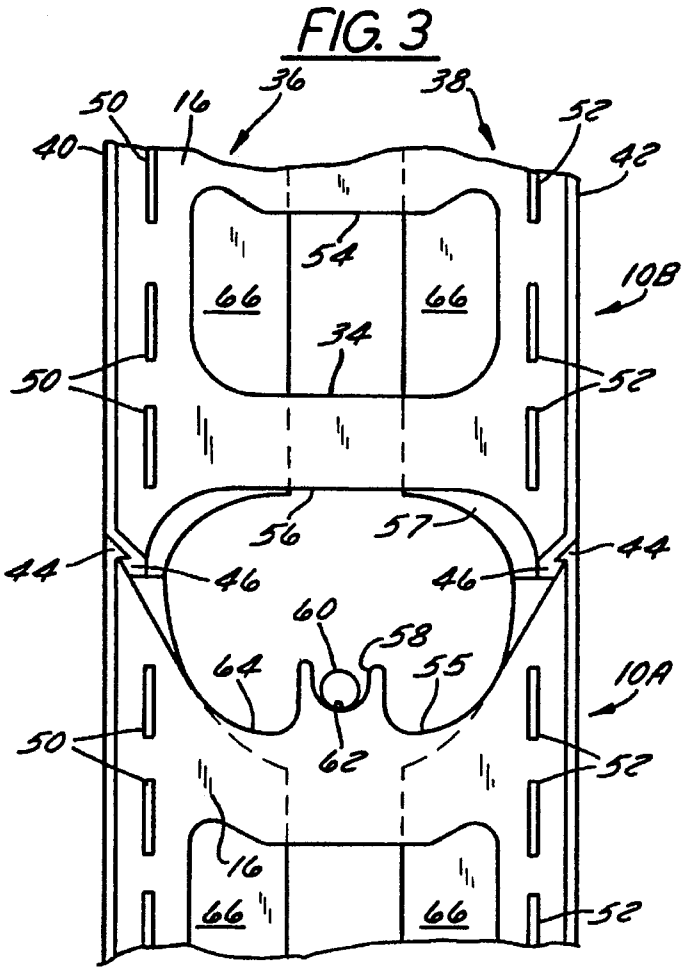
FIG. 3 is a view taken along the section 3—3 of FIG. 2, with some of lightweight foam removed for clarity.

FIG. 3 shows the lower hooks 46 on the left and right attachment flanges 40, 42 of a connector 16 in one block 10B connected to the upper hooks 44 of the left and right attachment flanges 40, 42 of a connector 16 in a block 10A. Before the concrete is poured, the hooks 44, 46 can flex a little bit in order to hook together, but, once the concrete is poured, the lower hooks 46 are pressed outwardly against the upper hooks 44 by the force of the concrete, thereby locking the hooks 44, 46 together and holding the connectors 16 together.

Figure 8:
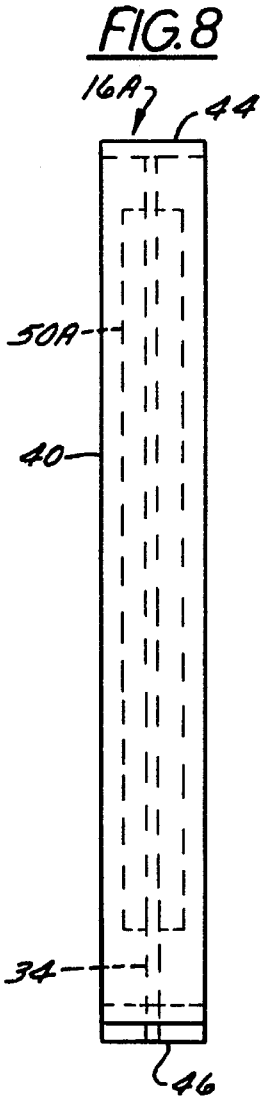
FIG. 8 is the same view as FIG. 7 but of a second embodiment of the connector of the present invention.

Referring now to FIGS. 4, 6, and 7, the web 34 of the connecting members 16, in addition to defining the transverse attachment flanges 40, 42, also defines left and right connecting flanges 50, 52 lying transverse to the direction of the web 34 and lying inside the attachment flanges 40, 42. The connecting flanges 50, 52 preferably are small flanges, lying on alternate sides of the web 34, as shown in FIG. 7. In an alternative embodiment, the connecting flanges can be continuous, as is the connecting flange 50A of FIG. 8. The purpose of the connecting flanges 50, 52 is to help retain the connectors on the sidewalls 12, 14.

Figure 9:
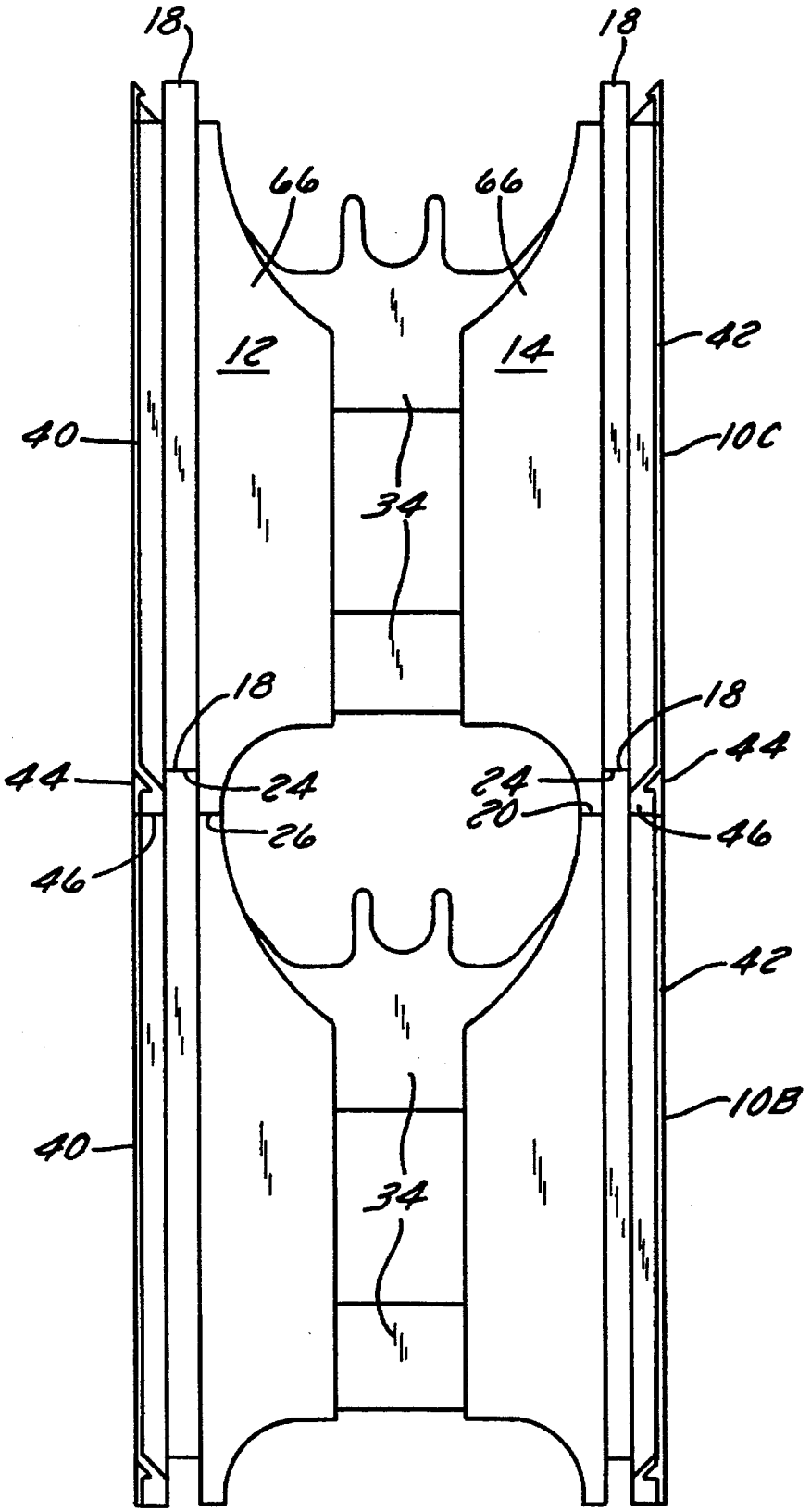
FIG. 9 is an end view of a portion of the wall of FIG. 2, showing how an upper block and lower block connect together.

FIG. 9 shows an upper block 10C connected to a lower block 10B. It shows the tongues 18 on the top 20 of the lower block 10B fitting into the grooves 24 in the bottom 26 of the upper block 10C. It also shows the upper hooks 44 on the lower block 10B hooked into the lower hooks 46 of the upper block 10C, aligning the upper and lower blocks and holding them together.

When the lightweight sheets 12, 14 are molded, they are formed around the connectors 16, so that the connecting flanges 50, 52 and part of the web 34 are embedded in the sheets 12, 14, and the attachment flanges 40, 42 are flush with the outside of the sheets 12, 14. The normally flat left and right sheets 12, 14 have inward projections 66 at the connecting members 16 to surround part of the webs 34, as shown in FIGS. 1, 2, 3, and 5. The process of forming polymeric foam sheets around connecting members is well-known in the art.

The attachment flanges 40, 42 extend the full height of their respective sheets 12, 14. The upper hooks 44 actually project a bit above their sheets 12, 14. The connectors 16 of this preferred embodiment are preferably made of a polymeric (plastic) material, and the attachment flanges 40, 42 are at least one-tenth of an inch thick and at least 1-¾ inches wide (preferably two inches wide).

Each web 34 also defines a large, central opening 54, which permits concrete to flow through the web 34. The top edge 55 and bottom edge 57 of the web 34 are substantially U-shaped and inverted U-shaped, respectively, so that, when upper and lower connectors 16 are connected together, as shown in FIG. 3, a large opening 56 is formed at the intersection of the upper and lower connectors 16 through which concrete can flow to form a horizontal concrete beam. The center of the top edge of the web 34 also defines a vertical projection including a small, U-shaped saddle 58 for receiving a reinforcing bar 60. The bottom 62 of the U-shaped saddle 58 is raised above the bottom 64 of the large U-shaped top edge 55 of the web 34 and above the U-shaped part of the projections 66 from the foam sheets, so that the reinforcing bar 60 will lie above the bottom of the horizontal concrete beam that will extend through the openings 56 when the concrete is poured.

The connectors 16 are preferably manufactured by molding a polymeric material to the shape shown in FIG. 4. Then, the connectors 16 are placed into a form (not shown) for forming the blocks 10. The blocks 10 are made by blowing a foam material into the form (not shown) so that the left and right sheets 12, 14 are formed with the tongues 18 and grooves 24 and with the inward projections 66, so that the connectors 16 are embedded in the sheets 12, 14.

The blocks 10 are then shipped to the construction site and are then stacked as shown in FIG. 2, with tongues fitting into grooves and respective upper and lower hooks 44, 46 mating with each other. Reinforcing bars 60 may be added both horizontally, as shown in FIG. 3, and vertically (not shown) as known in the art. Once the wall has been built up out of blocks 10, the concrete is poured and flows into the space between the sheets 12, 14, forming concrete walls, with horizontal and vertical beams. When the concrete has hardened and cured, finish materials can be added to the left and right sides of the wall 32. The finish materials preferably are added by screwing through the finish material and into the attachment flanges 40, 42. In this manner, a strong, well-insulated structure is built.

Figure 10:
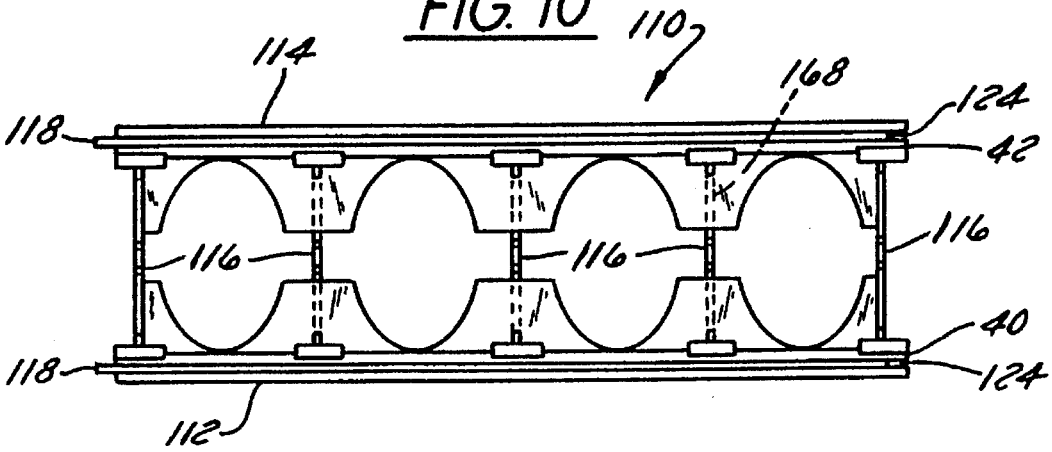
FIG. 10 is a top view of a block made with the connectors of FIGS. 16 and 17, with the connectors recessed from the outside walls of the block.
Figure 11:
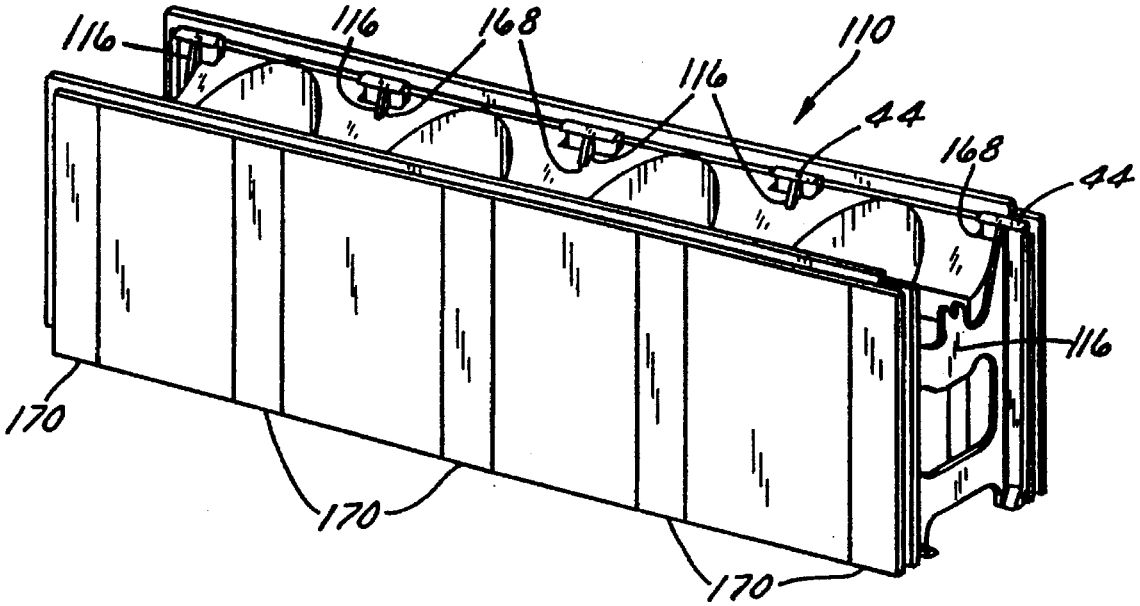
FIG. 11 is a perspective view of the block of FIG. 10.
Figure 13:
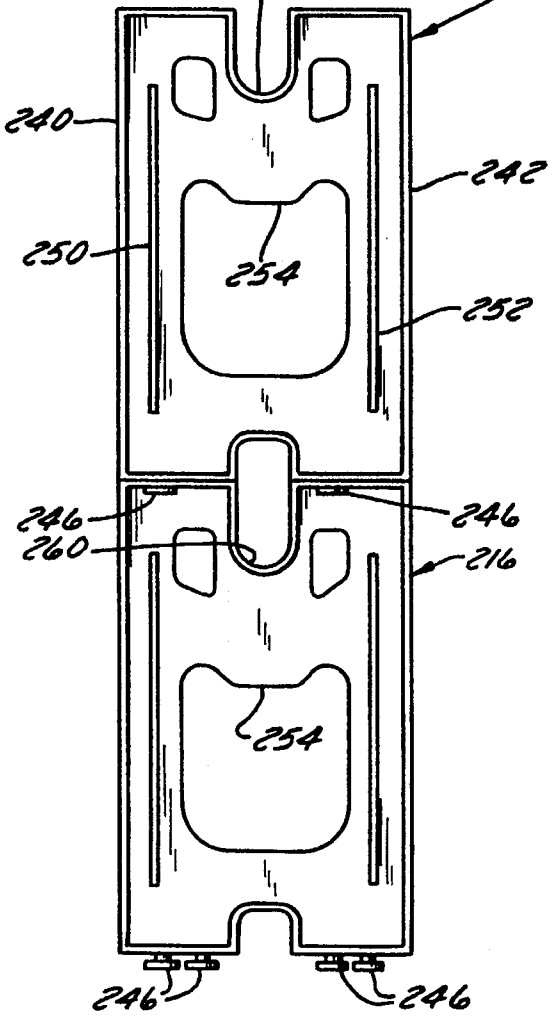
FIG. 13 is an end view of two of the connectors of FIG. 12 connected together.
Figure 17:
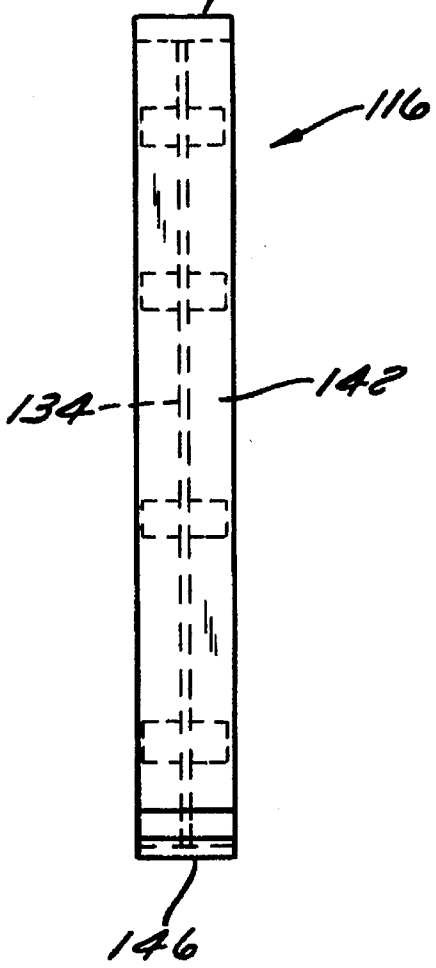
FIG. 17 is a side view of the connector of FIG. 16.

FIGS. 10–15 show some alternative embodiments of the present invention. FIGS. 10 and 11 show the connector 116 of FIGS. 16 and 17 in a slightly different type of block 110. The connector 116 is very similar to the connector 16 of FIG. 4, and comparable parts of the connector are given comparable numbers. This connector 116 has flanges 140, 142, the web 134, and upper and lower hooks 144, 146. It does not have connector flanges, but, instead, has ribs 141, which project from the flanges 140, 142 to give the flanges an effective thickness which is thick enough to fit the slots 168. In this case, the left and right sheets 112, 114 are molded without the connectors 116 in them. Instead, they are molded with slots 168 into which the connectors 116 can be slid in order to form the blocks 110. The connectors 116 are inserted from the bottom and are pushed up through the slots 168 until they reach the positions shown in FIG. 11. They will be glued in place to prevent the connectors from sliding relative to the sheets 112, 114. This arrangement reduces molding costs and reduces shipping costs, since the sheets 112, 114 and connectors 116 can be shipped flat and then assembled in the field. In this case, the attachment flanges 140, 142 are recessed inwardly from the outside walls of the left and right sheets 112, 114, and therefore cannot serve as visual indicators. Instead, the left and right sheets 112, 114 are simply painted or a strip of tape is added to the outside to provide a visual indicator 170 of the location of the connectors 16. Alternatively, a raised strip or indented strip may be molded into the sheets 112, 114 at the point of the connectors 116 to serve as a visual indicator. The visual indicator 170 shows the workers when the blocks are properly aligned and shows them where to fasten the wall finishings when the wall is complete. Except for the connectors 116 being inserted into slots 168 in the blocks 110, the blocks 110 function the same way as the blocks 10 which were described previously. Tongues 118 on one block fit into grooves 124 of the adjacent block, and the hooks 144, 146 connect in the same way as in the previous embodiment.

Figure 12:
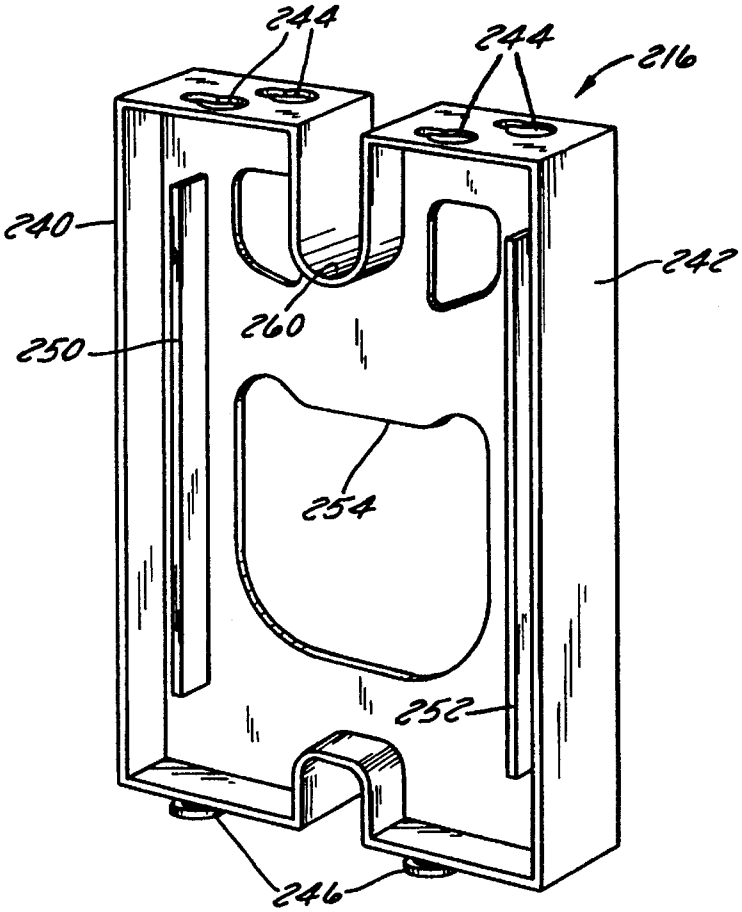
FIG. 12 is a perspective view of another connector.

FIGS. 12–15 show alternative embodiments of the connector. The connector 216 of FIG. 12 is very similar to the connector 16 of FIG. 4, except that the upper and lower connector mechanisms 244, 246 are different. The upper connectors 244 are holes with a reduced diameter portion, and the lower connectors 246 are projections with a large diameter head and a small diameter neck. To connect two of these connectors 216 together, the large heads of the projections 246 on the bottom of one connector are inserted into the large holes 244 on the top of the next connector, and the connectors 216 are then slid sideways until the necks of the projections enter the reduced diameter portions of the holes, locking the connectors 216 together. The rest of these connectors 216 are very similar to the connector of FIG. 4, with attachment flanges 240, 242, connecting flanges 250, 252, large central openings 254, and a rebar-receiving saddle 260. This type of connector 216 would probably have to be molded into the sheets when they are formed rather than inserted through slots, since the effective width of the connectors 216 would require the slots to be very large.

Figure 15:
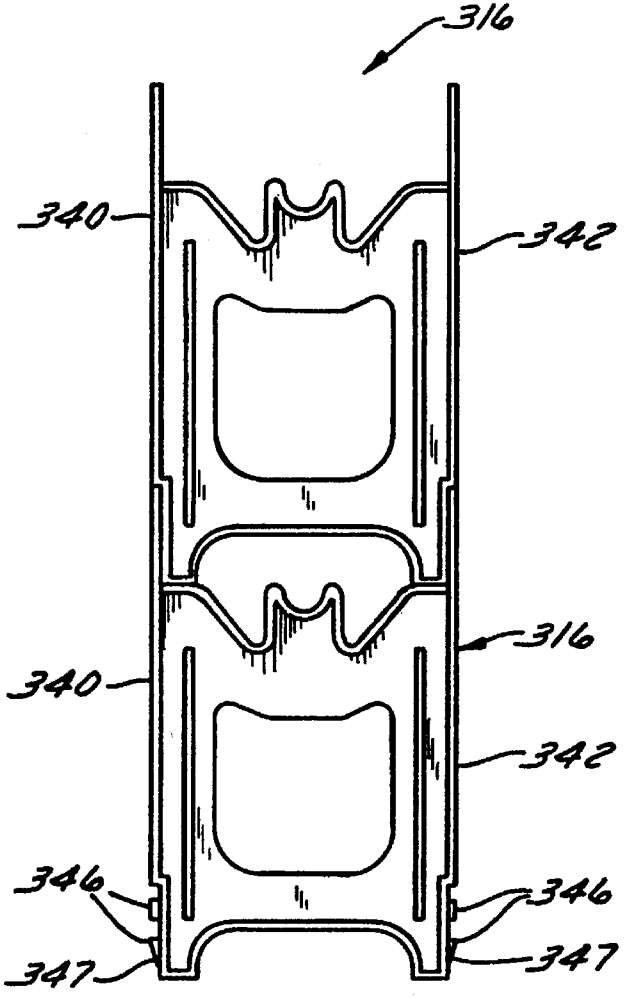
FIG. 15 is an end view of two of the connectors of FIG. 14 connected together.
Figure 14:
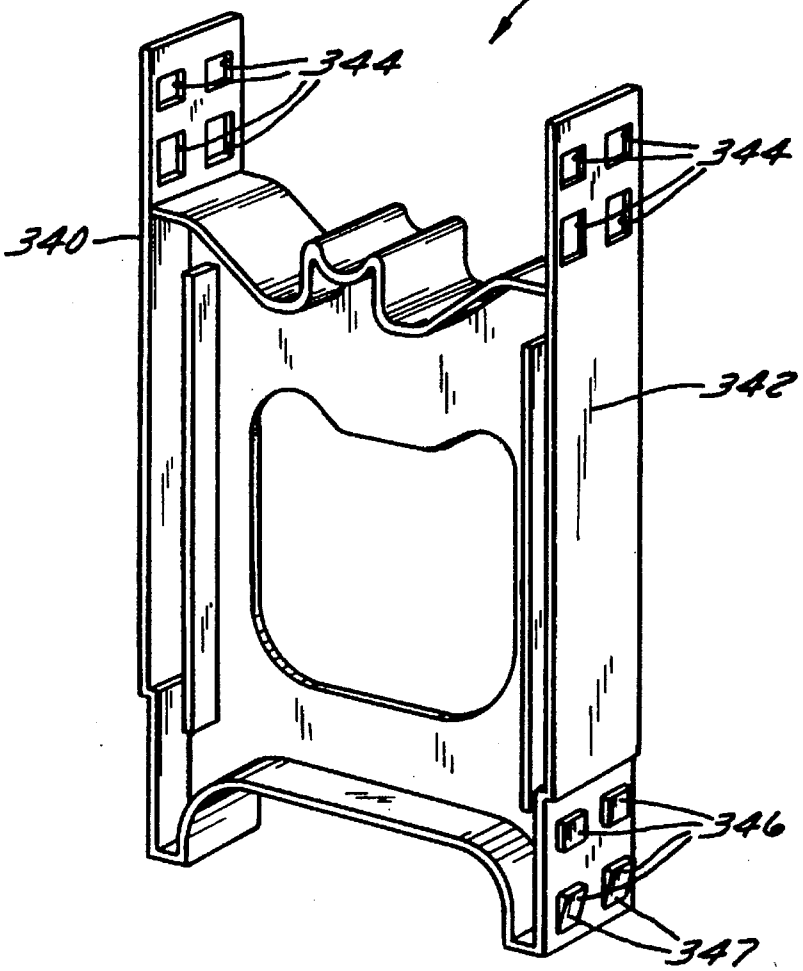
FIG. 14 is a perspective view of still another connector.
Figure 16:
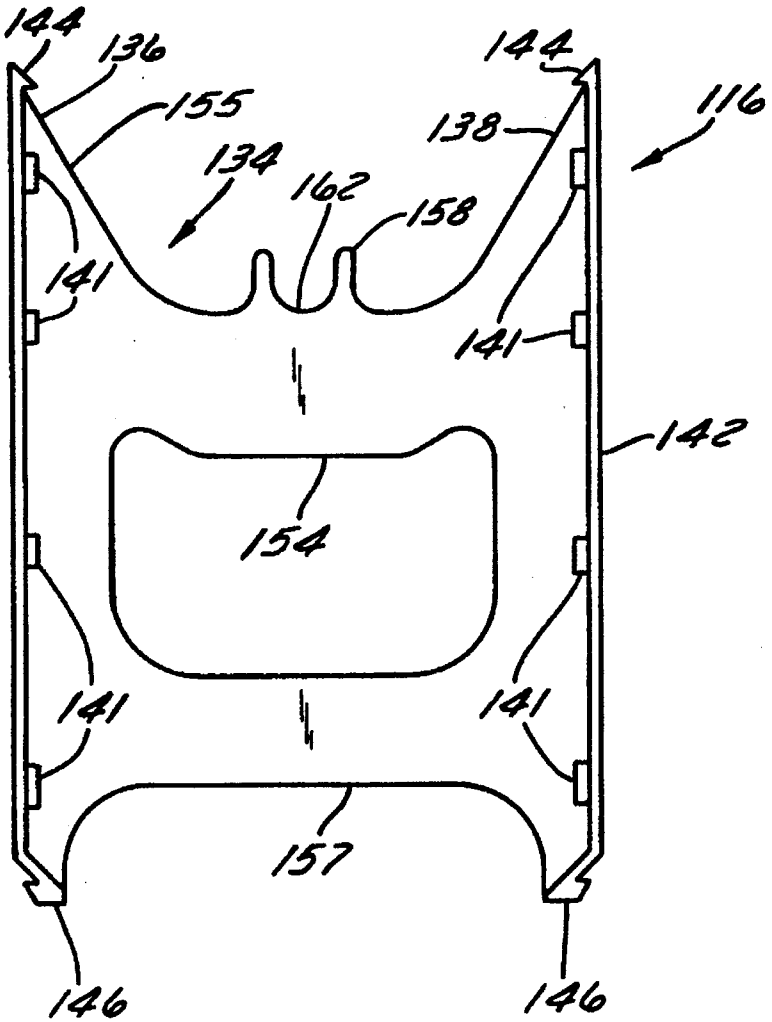
FIG. 16 is an end view of the connector used in the block of FIG. 10.

Another type of cooperating attachment mechanism on the top and bottom of the connector is shown in the connectors of FIGS. 14 and 15. FIG. 14 shows a connector 316 in which the attachment flanges 340, 342 have square holes 344 in their top portions which cooperate with square projections 346 in the lower portion of an adjacent connector 316. The lowermost projections 347 are tapered so that they provide a ramp which helps them flex for ease of installation. FIG. 15 shows two of these connectors 316 connected together.

It will be obvious to those skilled in the art that modifications may be made to the embodiments described above without departing from the scope of the present invention.

What is claimed is:

1. A connecting member for connecting together left and right parallel sheets to make a form for receiving concrete, comprising:

a connecting web defining left and right ends;

transverse attachment flanges adjacent the left and right ends of said connecting web;

said connecting member including upper and lower connecting mechanisms, so that, when another connecting member is placed directly above said connecting member, the upper connecting mechanism of said connecting member cooperates with the lower connecting mechanism of the other connecting member lying above it so as to hold the connecting members together.

2. A connecting member as recited in claim 1, wherein said connecting mechanisms are located adjacent the upper and lower edges of said connecting member.

3. A connecting member as recited in claim 2, wherein said connecting mechanisms are located on said attachment flanges.

4. A connecting member as recited in claim 3, wherein said connecting mechanisms include hooks.

5. A connecting member as recited in claim 2, wherein said connecting mechanisms are located on said web.

6. A connecting member as recited in claim 3, wherein said connecting mechanisms extend substantially the full width of their attachment flanges.

7. A connecting member as recited in claim 4, wherein one of the upper and lower hooks of the connecting member is directed outwardly away from the web, and the other of the upper and lower hooks is directed inwardly toward the web.

8. A connecting member as recited in claim 1, wherein said attachment flanges extend the full length of said connecting member such that, when another connecting member is located above said connecting member and the connecting mechanisms of the said connecting member and the above connecting member are mated, there is a continuous attachment flange running the full height of the two connecting members.

9. A connecting member as recited in claim 1, wherein at least one of said transverse attachment flanges on said connecting member extends across the web so that the cross-section of the web and said transverse attachment flange forms substantially a T-shape.

10. A connecting member as recited in claim 9, wherein both of said transverse attachment flanges extend across the web so that the cross-section of the web and said left and right transverse attachment flanges forms substantially an I-shape.

11. A connecting member as recited in claim 1, and further comprising at least one left connector flange spaced inwardly from said left attachment flange and at least one right connector flange spaced inwardly from said right attachment flange.

12. A connecting member as recited in claim 11, and further comprising a large, central opening in said web for permitting concrete to flow through said web.

13. A connecting member as recited in claim 1, and further comprising a vertical projection extending from the top center edge of said web, said vertical projection defining a saddle for receiving a reinforcing bar, wherein the bottom point of said saddle lies above the lowest point of the top edge of said web.

14. A connecting member as recited in claim 1, wherein said attachment flanges are at least 1-¾ inches wide and at least 1/10 inch thick.

15. A connecting member as recited in claim 1, wherein said connecting member is made of plastic.

16. In a form for receiving concrete, comprising left and right parallel walls having inner and outer surfaces and a plurality of connecting members which hold said left and right walls a fixed distance apart; wherein said walls define slots which receive the connecting members, and the connecting members terminate at their respective slots, before reaching the outer surfaces of said left and right parallel walls; and further comprising:

visual indicators on the outside of said left and right parallel walls to show where the connecting members are located; wherein said connecting members extend substantially the full height of said form so that, when several of these forms are stacked together and concrete is poured into them, the connecting members provide a structure to which wall finishes can be attached along the full height of the wall.

17. A connecting member as recited in claim 1, in combination with left and right parallel sheets, wherein said connecting member connects together said left and right parallel sheets.

18. A connecting member as recited in claim 17, wherein said left and right parallel sheets define vertical slots, which receive the left and right transverse attachment flanges of said connecting member, respectively.

19. A connecting member as recited in claim 18, wherein said connecting mechanisms on said connecting member include hooks.

20. In a form for receiving concrete as recited in claim 16, wherein said visual indicators include a coating on the outside of the walls.

21. In a form for receiving concrete as recited in claim 16, wherein said connecting member include left and right attachment flanges having a fastener mechanism at their upper and lower edges so that, if another form is stacked on top of said form, with the connecting members of the other form aligned with the connecting members of said form, the fastener mechanisms at the lower edges of the connecting members on the other form fasten to the fastener mechanisms at the upper edges of the connecting members0 of said form so as to hold the forms together and so as to provide a continuous vertical attachment flange extending along both the upper and lower forms.

22. In a form as recited in claim 21, wherein said connecting member includes a web, and said left and right attachment flanges extend transversely across said web, such that said web lies approximately at the midpoint of said attachment flanges.

23. In a form as recited in claim 16, wherein said connecting member includes a web, which defines a large central opening to permit concrete to flow through and left and right connector flanges transverse to said web and embedded in said left and right walls, respectively.

24. In a form as recited in claim 16, and further comprising a saddle in the upper portion of said web for receiving a reinforcing bar.

25. In a form as recited in claim 16, wherein said connectors are made of polymeric material, and said attachment flanges are at least one-tenth inch thick.

* * * * *

UNITED STATES PATENT AND TRADEMARK OFFICE

CERTIFICATE OF CORRECTION

PATENT NO. : 5,459,971

DATED : October 24, 1995

INVENTOR(S) : Sparkman, Alan

It is certified that error appears in the above-indentified patent and that said Letters Patent is hereby corrected as shown below:

In column 3, line 4, "preset" should read --present--
In column 3, line 8, insert --the-- before "lightweight"
In column 8, line 41, insert an --s-- at the end of "member"
In column 8, line 61, Claim 24 should read --24. In a form as recited in claim 16, wherein said connecting member includes a web, and a saddle in the upper portion of said web for receiving a reinforcing bar.--

Signed and Sealed this

Twenty-first Day of May, 1996

*Attest:*

Bruce Lehman

BRUCE LEHMAN

*Attesting Officer*

*Commissioner of Patents and Trademarks*